United States Patent [19]

Davidson

[11] 4,201,291

[45] May 6, 1980

[54] DISPLAY CARTON

[75] Inventor: Thomas L. Davidson, Uncasville, Conn.

[73] Assignee: Robertson Paper Box Co., Inc., Montville, Conn.

[21] Appl. No.: 136

[22] Filed: Jan. 2, 1979

[51] Int. Cl.[2] ..... B65D 5/64

[52] U.S. Cl. ..... 206/44 R; 206/45.29; 206/621

[58] Field of Search ..... 206/44, 44 B, 44 K, 206/45.12, 45.2, 45.21, 45.23, 45.28, 45.29, 604, 620, 621, 628, 634; 229/17 R

[56] References Cited

U.S. PATENT DOCUMENTS

| | | | |
|---|---|---|---|
| 1,271,201 | 7/1918 | Muegge | 206/44 B |
| 3,392,903 | 7/1968 | Morgan | 206/44 R |
| 3,469,765 | 9/1969 | Mueller | 206/45.29 |
| 3,567,105 | 3/1971 | McFarlin | 229/17 R |
| 4,141,449 | 2/1979 | Stone | 206/621 |

*Primary Examiner*—Herbert F. Ross
*Attorney, Agent, or Firm*—Cesari and McKenna

[57] ABSTRACT

An improved display and dispensing carton comprising front and rear walls, top and bottom walls and a pair of side walls all hinged together to form a generally rectangular enclosure has a rear wall composed of a plurality of separate plies which are connected flush together to form a relatively tear-resistant laminated wall structure. Openings are provided in the rear wall to receive a bracket for supporting the carton at the point of sale. A tear line extends along said carton top wall to facilitate removal of part or all of the top wall and part of the front wall at the point of sale and an advertising flap is connected to one of said rear wall plies underneath said cover so that when the cover portion is removed, the flap pops up above the carton more or less coplanar with the rear wall side to which it is connected to serve as an advertising surface.

7 Claims, 4 Drawing Figures

DISPLAY CARTON

BACKGROUND OF THE INVENTION

This invention relates to a carton or box. It relates more particularly to a carton which can also be used as a dispenser and display for the carton contents.

In order to minimize materials and handling costs, it is common practice to have a carton perform the dual functions of a container for shipping articles from the manufacturer to the retailer and a dispenser for dispensing the articles at the retailer's point of sale. Often such dispenser-type cartons also include an upstanding card or flap for advertising the particular product. To avoid having to provide separate racks for such display-type cartons, they are frequently removably secured to existing shelves in the store by means of some sort of bracket or clamp. The bracket engages in the carton and is attached to the front edge of the shelf so that the carton projects out from the shelf toward the prospective purchaser so as to maximize the carton's visibility and accessibility.

Prior cartons of this general type have been disadvantaged, however, in that when they are secured to a shelf by a bracket, they tend to sag due to the weight of the carton contents and also due to purchasers pushing down on the carton as they withdraw articles from the carton. Such sagging of the carton renders the display less pleasing to the eye and thus less effective. If the sagging of the carton becomes excessive, the advertising indicia may be partially or completely concealed. Also the contents of carton may fall onto the floor. In addition, the carton itself may tear at its point or points of attachment to the bracket with the result that the entire carton and its contents drop to the floor.

Another problem with display cartons of this general type is that in many cases they have a substantial vertical extent so that they tend to conceal articles on the shelf behind the carton. Consequently, in some cases store owners are reluctant to mount the cartons at their proper locations at the fronts of the shelves because of inquiries and complaints about such concealed merchandise. Finally prior display cartons of this general type tend to be relatively complicated structures requiring several cutting, bending and folding operations in order to form the carton and erect it for display. Consequently, those containers are relatively expensive in terms of material, cost and set-up time.

SUMMARY OF THE INVENTION

Accordingly, the present invention aims to provide an improved display carton which can remain suspended at the point of sale for a prolonged period without sagging.

Another object of the invention is to provide a carton of this type which is capable of supporting a relatively heavy weight without losing its shape.

Another object of the invention is to provide a display carton whose contents is readily accessible to prospective purchasers at the point of sale.

Still another object of the invention is to provide an improved carton of this type which can be made from a single cardboard blank.

A further object of the invention is to provide a carton which is arranged to be suspended from a bracket in order to display and dispense articles, yet which does not tend to tear because of forces exerted upon it.

Still another object of the invention is to provide a carton of this type which is arranged to be supported by a bracket and which is reinforced at the points of its securement to the bracket.

A further object of the invention is to provide such a carton which is particularly resistant to racking.

Another object of the invention is to provide a display carton which can be secured at a plurality of different heights to a shelf or other support.

Still another object of the invention is to provide a blank for forming a carton having one or more of the above characteristics.

In general, the subject carton is generally rectangular in shape having a top wall, a bottom wall, a front wall, a rear wall and a pair of side walls. The rear wall of the carton comprises three separate glued together plies thereby making it relatively rigid and tear resistant.

Connected to the top of one of the plies is a flap which is folded flat against the carton contents when the carton cover is closed. The carton is formed with tear lines or perforations in its front and top walls which permit portions of the front and top walls to be removed from the remainder of the carton, thereby exposing the carton contents. When those wall portions are stripped away, the flap connected to the rear wall ply pops up and displays an advertising message printed on the flap.

Preferably the tear lines are formed in the carton top wall so as to leave triangular webs at the four corners of the carton when the top cover is stripped away which webs reinforce the carton sidewalls and make the overall carton more resistant to racking.

A plurality of slots or similar openings are formed in the carton rear wall at spaced-apart locations along that wall. These openings are arranged to receive the fingers of one or more clips which grip the rear wall and may be secured to the front edge of a shelf or other support so that the carton is suspended from that support and is quite visible and readily accessible to prospective purchasers of the carton contents.

The carton is constructed with a relatively low profile so that it does not tend to overly conceal articles on the shelf behind the carton. Also to further minimize any such tendency, the carton rear wall may be formed with a plurality of different sets of clip slots at different heights on the rear wall so that the carton can be supported at a plurality of different heights relative to the shelf or other support.

The aforesaid display carton is formed from a single blank of material using only a single glueing operation and three folding operations and may be shipped in that flattened, knocked-down state. The carton is erected by opening it to its generally rectangular shape and glueing the end flaps forming the carton end walls in the usual manner. Thus the carton is characterized by relatively low material and set-up costs.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 2:
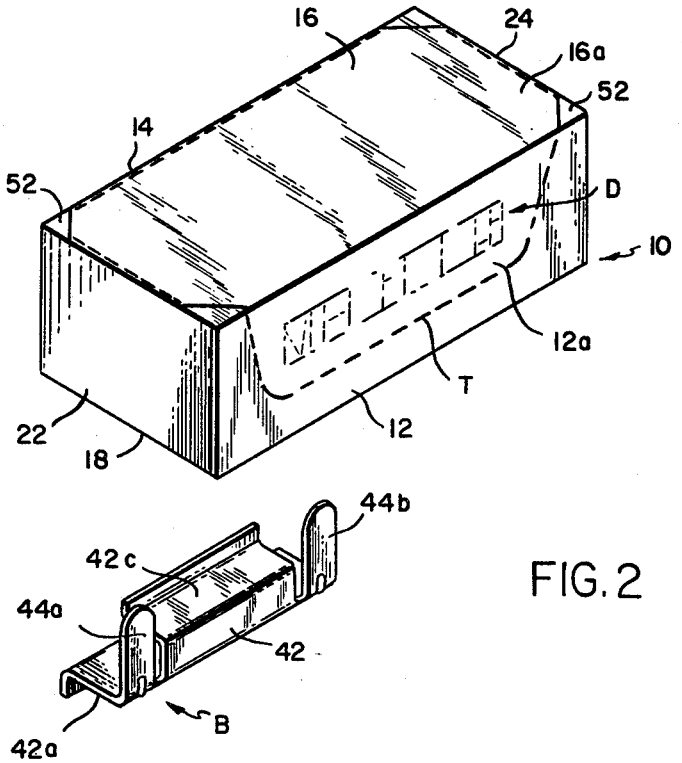
FIG. 2 is an exploded perspective view showing the carton fully closed with its supporting bracket.

Referring first to FIG. 2 of the drawings, the subject carton indicated generally at 10 has a front wall 12, a rear wall 14, a top wall 16 and a bottom wall 18 and a pair of side or end walls 22 and 24. Carton 10 is shipped that way to the retailer and arranged to be suspended from a shelf or other support at the point of sale by means of a rigid bracket indicated generally at B.

A tear line T is formed in carton 10 which extends along the side and rear edges of the carton top wall 16, except for the corners thereof and down and across the carton front wall 12. Tear line T permits the top wall and a portion **12*a*** of the front wall to be stripped away from the remainder of the carton at the point of sale in order to display and dispense the carton contents.

Figure 1:
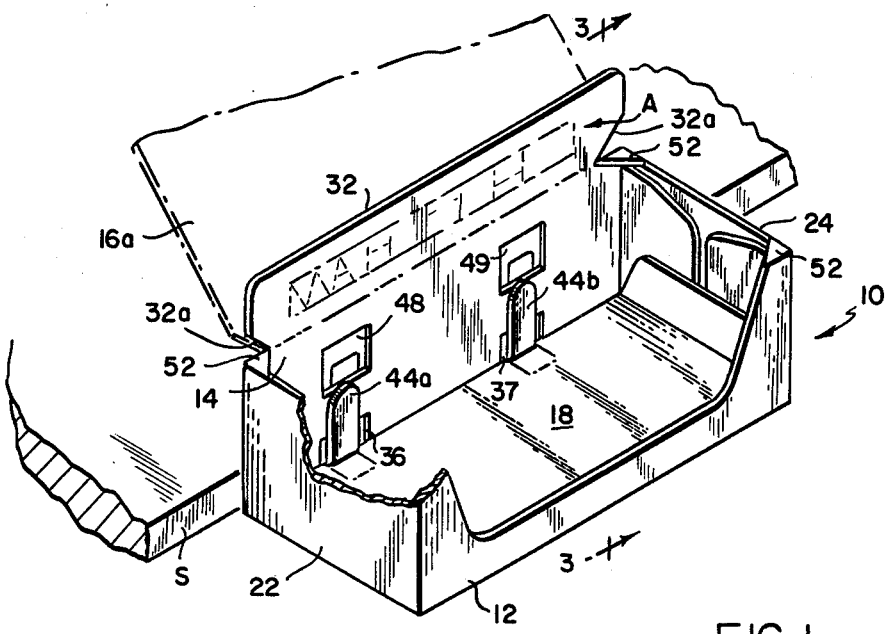
FIG. 1 is a perspective view of an improved display carton made in accordance with this invention showing the carton supported and in condition for displaying and dispensing articles.

In accordance with the directions D conveniently printed on the carton front wall portion **12*a*, the carton front wall portion 12*a* and the carton top wall portion 16*a*, i.e. that entire wall 16, except for the corners thereof, are stripped away along the tear line T, thereby opening the carton as illustrated in FIG. 1. As soon as the cover portion 16*a* shown in dotted lines in FIG. 1 is removed, a flap 32 hinged to the top edge of the carton rear wall and normally trapped between the cover 16 and the carton contents pops up to a substantially vertical position as shown in FIG. 1. The flap has an angled cutout 32*a* at the base of each end which permits the flap to clear the reinforcing webs 52 struck from cover 16**. The flap may carry advertising matter indicated generally at A which projects above the carton and is quite visible and prominent.

A pair of slots or openings 36 and 37 are formed near the bottom edge of the carton rear wall 14 at spaced-apart locations along that rear wall. These openings facilitate securing the carton 10 to the bracket B.

Referring to FIG. 2, the bracket B is a one piece metal or plastic part. It comprises a bottom wall **42*a* which extends the entire length of the bracket and an upstanding front wall 42*b* which is narrower than wall 42*a* and a top wall 42*c* integral with wall 42*b* spaced generally parallel above wall 42*a*. Integral with the ends of the bracket wall 42*a* are a pair of resilient fingers 44*a* and 44*b* which extend up just beyond the ends of bracket wall 42*b*. These fingers are more or less coplanar with bracket wall 42*b*** so that the wall and the fingers together comprise a clip.

Figure 3:
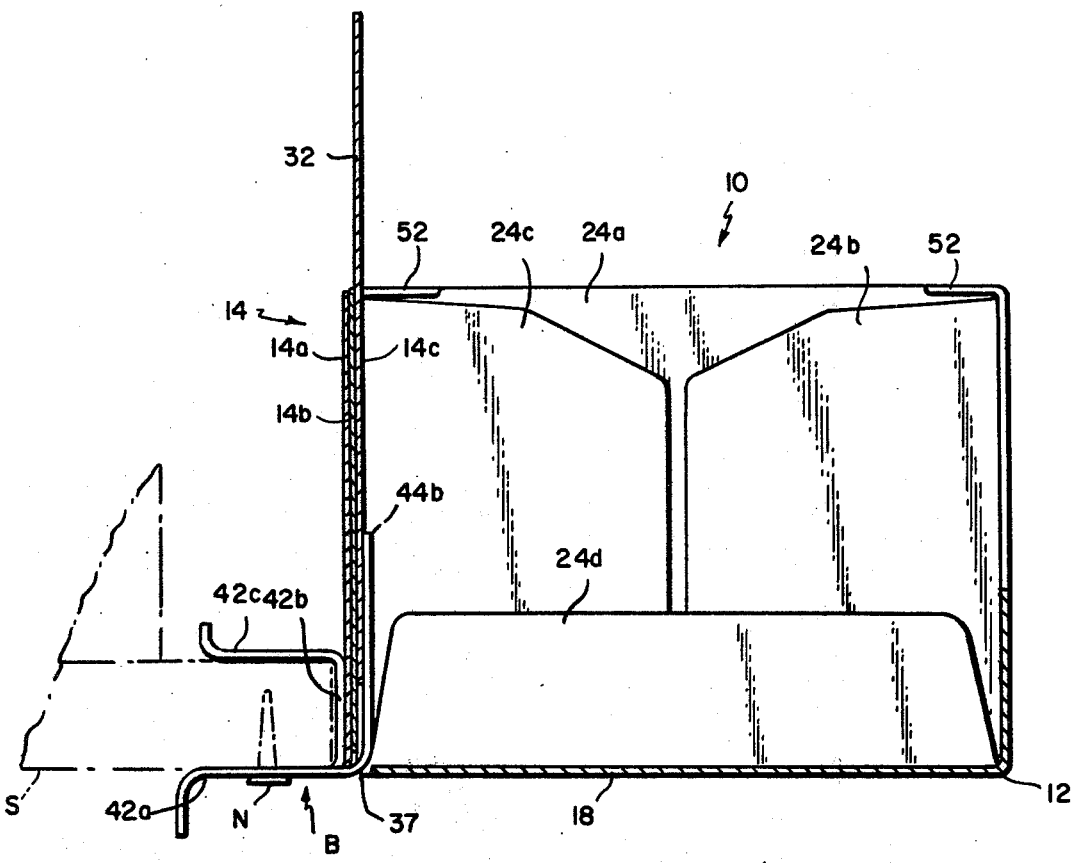
FIG. 3 is a sectional view along line 3—3 of FIG. 1.

As best seen in FIGS. 1 and 3, the bracket B is removably secured to the carton by projecting its fingers **44*a* and 44*b* through the slots 36 and 37 so that the fingers engage the inside surface of the carton rear wall and the bracket wall 42*b* engages the outside surface of that same wall whereby the bracket securely grips the carton. Then bracket B is clipped onto the exposed edge of a shelf S with the shelf being received between the bracket walls 42*a* and 42*c* as shown in FIG. 3. The leading edges of these walls are turned away from one another to facilitate such installation. A nail or tack N (FIG. 3) may be driven through a convenient hole in bracket wall 42*a*** with the underside of the shelf to hold the bracket in place.

With the carton 10 secured to shelf S in that fashion by bracket B, the bottom wall 18 of the carton is more or less even with the underside of the shelf S. Consequently, the carton 10 including the flap 32 does not extend appreciably above the shelf. Therefore it does not unduly obscure articles that may be located on the shelf behind the carton. If desired, however, the mounted carton can be given an even lower profile by engaging the bracket fingers **44*a* and 44*b* in a second pair of spaced-apart slots or openings 48 and 49 located midway up on the carton rear wall 14 as shown in FIG. 1. Using those openings, the carton is supported by bracket B so that its bottom wall 18** is located appreciably below the underside of shelf S with the result that the overall carton does not project above the shelf very much at all.

As best seen in FIG. 2, tear line T is arranged to leave the corners of the carton top wall 16 intact. These corners form generally triangular webs 52 which interconnect adjacent walls of the carton and substantially rigidify the top of the carton when it is open. Thus the webs lend substantial reinforcement to the top of the carton so as to make the carton quite resistant to distortion and racking as might occur due to an unbalanced load in the carton or due to someone pressing down on a portion of the carton while removing an article therefrom.

Referring now to FIG. 3, the carton rear wall 14 is actually composed of three separate plies, **14*a*, 14*b* and 14*c*, all of which are glued together. These plies thus form a laminated structure which makes the overall rear wall 14 quite rigid and strong and resistant to tearing, particularly in the regions of the slots 36 and 37 (or 48 and 49) where the connections to the bracket B are made so that high shear forces are present due to the torque caused by the weight of the carton contents. Under load, the opening edges formed by the carton rear wall engage against the bases of the bracket fingers so that the forces on the rear wall are compressive and do not tend to tear that wall. Therefore a plural ply bottom wall is not necessary. Consequently, the carton 10 has little tendency to sag or droop under the weight of its contents or due to purchasers pressing down on the carton while removing articles therefrom. The advertising flap 32 is actually connected to the top edge of the rear wall ply 14*c*** as will be seen presently.

Figure 4:
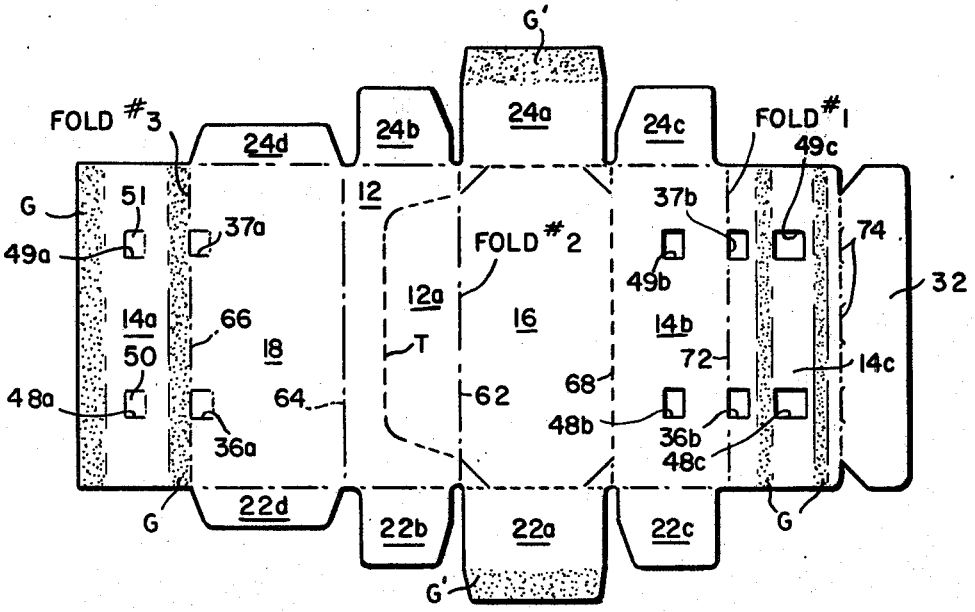
FIG. 4 is a top plan view of the blank from which the FIG. 1 carton is formed.

Turning now to FIG. 4, all of the carton walls including the laminated rear wall 14 are made from the single piece of board illustrated in that figure. The front wall panel 12 is hinged along fold lines 62 and 64 to the carton top and bottom wall panels 16 and 18 respectively. The bottom wall panel 18 is also hinged along a fold line 66 to the outermost rear wall ply **14*a*. The carton top wall panel 16 is also hinged along fold line 68 to the middle rear wall ply 14*b* whose opposite side is hinged along fold line 72 to the innermost rear wall ply 14*c*. The connection or that ply 14*c* to the flap 32 is made along a line 74 which is a partially slit line so that when flap 32 is bent relative to ply 14*c* it naturally tends to return to its original position coplanar with that ply. Consequently, that flap tends to pop up vertically when the top wall portion 16*a* is removed as shown in FIG. 1**.

The carton end walls 22 and 24 are actually composed of main end wall flaps **22*a* and 24*a* hinged to the opposite ends of panel 16 and auxiliary flaps 22*b* to 22*d* and 24*b* to 24*d* hinged in the usual fashion at the opposite ends of panels 12, 14*b* and 18** respectively. Of course, any other conventional end wall flap arrangement can be used to close off the ends of the carton.

Since the carton rear wall is composed of plural plies, the openings 36 and 37 therein are actually comprised of a plurality of openings 36a and 37a in panel 18 adjacent hinge line 66 and 36b and 37b in panel 14c adjacent hinge line 72. Likewise the alternate openings 48 and 49 are composed of openings 48a and 49a in panel 14a midway between its side boundaries, openings 48b and 49b in panel 14b intermediate its side boundaries and openings 48c and 49c in panel 14c between its side boundaries. These openings are preferably holes rather than slits so that they present no registration problem. The openings in the outermost ply 14a are formed by punch out tabs 50 and 51 (FIG. 4) so that in transit the carton is completely closed to keep out dirt.

The tear line T extends, as indicated, between the front wall portions 12 and 12a along the hinge lines between the top wall 16 and the end flaps 22a and 24a and along the hinge line 68 with rear wall ply 14b all as shown in FIG. 4. Also a pair of glue lines G are printed on panel 14a, as indicated, on opposite sides of the opening 48a and 49a therein. A similar pair of glue lines G are printed on panel 14c on opposite sides of the openings 48c and 49c therein.

The box is made up by first folding the blank along hinge line 72. Then the blank is folded again along hinge line 62 and finally the thus folded blank is folded further along hinge line 66, all as indicated in FIG. 4. This causes the rear wall panels 14b and 14c to adhere together face-to-face. Also the panel 14a is adhered to the opposite face of panel 14b forming the laminated carton rear wall 14. The carton is normally shipped in that flattened condition. It is erected by squaring it into its rectangular form. Then one end, say end wall 24, is closed by folding the flap 24d, then flaps 24b and 24c and then folding the outer flap 24a on which a glue line G' is applied which thereupon adheres to flap 24d. Articles are loaded into the carton through the opposite end and then the end wall 22 is closed in the same manner, another glue line G' being applied to the edge of flap 22a.

It is seen from the foregoing then, that the carton described herein with its three-ply laminated rear wall and its reinforced corners provides a very sturdy structure which can be supported by way of a bracket from a shelf or other support without sagging or otherwise losing its shape due to the weight of its contents or due to the effect of purchasers pushing against the carton. When the carton is mounted as shown, it functions as a dispenser and a display for articles in the carton. The carton arrives at the retailer in a closed sealed condition. When the carton top cover wall is removed, a billboard flap containing an advertising message automatically pops up to an erect position in which it is readily visible above the carton. Still, however, the carton does not have a very high profile. Consequently, when it is mounted at the front of a shelf by engaging the bracket B over the edge of the shelf or by clipping the outturned edges of bracket portions 42a and 42c into the pricing channel of standard supermarket shelving, it does not unduly conceal or obscure the merchandise located on the shelf behind the carton.

Still further, provision is made for mounting the carton at different selected heights relative to the shelf so that placement of the carton can be higher or lower relative to the shelf depending upon the height of the other merchandise on the shelf. With all of these advantages, the subject carton is constructed from a single blank of material in only three folding steps. Consequently, the overall cost of the carton is no more than that of prior comparable containers of this general type.

The specific bracket used in conjunction with the subject carton may assume any one of a variety of shapes. The illustrated resilient bracket having upstanding clip-like fingers which engage the carton is a particularly desirable type of bracket. It may be resiliently engaged over the front edge of a shelf in a store so as to securely clip the carton to the shelf with the carton projecting out toward the prospective customer.

It will thus be seen that the objects set forth above, among those made apparent, from the preceding description are efficiently attained and, since certain changes may be made in the above construction without departing from the scope of the invention, it is intended that all matter contained in the above construction or shown in the accompanying drawings shall be interpreted as illustrative and not in a limiting sense.

It is also to be understood that the following claims are intended to cover all of the generic and specific features of the invention herein described.

I claim:

1. An improved display carton comprising top and bottom wall panels, front and rear wall panels, and a pair of end wall panels all hinged together to form a generally rectangular enclosure, said carton rear wall being formed of a plurality of plies, means adhering said plies together to form a relatively tear-resistant laminated wall structure, means defining one or more bracket-receiving openings in said carbon whereby said carton may be supported by way of its said rear wall, means defining a tear line extending over a portion of said carton around a closed path to facilitate the complete removal of at least a portion of said carton top wall so as to expose the contents of said carton, and a carton flap connected to one of said rear wall plies underneath said top wall so that when said top wall portion is removed, said flap projects up out of the carton and stands more or less coplanar with the wall ply to which it is connected.

2. The carton defined in claim 1 wherein said openings are formed at the boundary between said rear wall and said bottom wall.

3. The carton defined in claim 1 wherein said openings are formed in said rear wall at the same height on said wall.

4. The carton defined in claim 1 wherein said tear line also extends along a portion of said carton front wall.

5. The carton defined in claim 4 wherein said tear line extends around said side and rear edges of said carton top wall and also extends along said carton front wall along a line spaced upwardly from the lower edge of said front wall.

6. The carton defined in claim 1 wherein said tear line bypasses the corners of said carton top wall so that when said wall portion is torn away the corners of said top wall remain as reinforcing webs interconnecting adjacent walls of said carton.

7. The carton defined in claim 1 and further including a bracket having resilient fingers projecting through said openings and engaging the inside surface of said rear wall and an upstanding bracket wall extending more or less parallel to said fingers and engaging the outside surface of said rear wall whereby said carton is clipped to said bracket.

* * * * *